United States Patent [19]

Knauer

[11] Patent Number: 4,886,969

[45] Date of Patent: Dec. 12, 1989

[54] CLUSTER BEAM APPARATUS UTILIZING COLD CATHODE CLUSTER IONIZER

[75] Inventor: Wolfgang Knauer, Malibu, Calif.

[73] Assignee: Hughes Aircraft Company, Los Angeles, Calif.

[21] Appl. No.: 285,830

[22] Filed: Dec. 16, 1988

[51] Int. Cl.[4] ..... H01J 31/08

[52] U.S. Cl. ..... 250/427; 250/423 R; 315/111.81

[58] Field of Search ..... 250/427, 423 R; 315/111.81; 204/192.11, 192.31

[56] References Cited

U.S. PATENT DOCUMENTS

| | | | |
|---|---|---|---|
| 4,152,478 | 5/1979 | Takagi | 204/192.11 |
| 4,737,637 | 4/1988 | Knduer | 250/281 |
| 4,755,344 | 7/1988 | Friedman et al. | 250/423 R |

*Primary Examiner*—Jack I. Berman

*Attorney, Agent, or Firm*—W. K. Denson-Low; P. M. Coble

[57] ABSTRACT

An apparatus for producing a beam of ionized clusters includes a source that emits a beam of clustered and unclustered atoms through a nozzle and a cold cathode ionizer that ionizes the clusters. The ionizer is positioned in close proximity to the nozzle and the beam as it is emitted from the nozzle. A plasma is formed in the beam adjacent the nozzle when secondary electrons emitted from the cathode are accelerated and injected into the beam, resulting in the ionization of atoms and clusters. The cathode is preferably formed, at least in part, of a material that efficiently emits secondary electrons when impacted by ionized atoms extracted from the plasma to impact against the cathode, and the secondary electrons are injected into the plasma to renew the process. The ionized clusters remain in the beam and proceed to their target.

20 Claims, 2 Drawing Sheets

CLUSTER BEAM APPARATUS UTILIZING COLD CATHODE CLUSTER IONIZER

This invention was made with Government support under Contract No. N00014-86-C-0705 awarded by the Department of the Navy. The Government has certain rights in this invention.

BACKGROUND OF THE INVENTION

This invention relates to cluster beams, and, more specifically, to apparatus for producing cluster beams using a cold cathode ionizer.

The deposition of thin films upon substrates is an important manufacturing and research tool in a variety of fields. For example, microelectronic devices are prepared by depositing successive film layers onto a substrate to obtain specific electronic properties of the composite. Photosensitive devices such as vidicons and solar cells are manufactured by depositing films of photosensitive materials onto substrates. Optical properties of lenses are improved by depositing films onto their surfaces. These examples are, of course, only illustrative of the thousands of applications of thin film deposition techniques.

In the highly controlled approach to thin-film deposition that is characteristic of applications wherein a high quality film is required, the film is built up by successive deposition of monolayers of the film, each layer being one atom thick. The mechanics of the deposition process can best be considered in atomistic terms. Generally, in such a process the surface of the substrate must be carefully cleaned, since minor contaminant masses or even contaminant atoms can significantly impede the deposition of the required highly perfect film. The material of the film is then deposited by one of many techniques developed for various applications, such as vapor deposition, sputtering, chemical vapor deposition, or electron beam evaporation.

In another technique for depositing thin films, ionized clusters of atoms are formed in a cluster source. These clusters usually have on the order of about 1000 (and sometimes up to 10,000) atoms per cluster. The clusters are ionized and then accelerated toward the substrate target by an electrical potential that imparts an energy to the cluster equal to the accelerating voltage times the ionization level of the cluster. Upon reaching the surface of the substrate target, the clusters disintegrate at impact. Each atom fragment remaining after disintegration has an energy equal to the total energy of the cluster divided by the number of atoms in the cluster. The cluster prior to disintegration therefore has a relatively high mass and energy, while each atom remaining after disintegration has a relatively low mass and energy. The energy of the atom deposited upon the surface gives it mobility on the surface, so that it can move to imperfections such as kinks or holes that might be present on the surface. Some of the deposited atoms come to rest in the imperfections, thereby removing the imperfections and increasing the perfection and density of the film. Other approaches to using clusters have been developed, and it appears that deposition using cluster beams is a promising commercial film-manufacturing technique.

In current apparatus for producing cluster beams, the clusters are ionized by a thermionic ionizer. Such an ionizer includes a cathode that is heated to a very high temperature by the passage of an electrical current therethrough. The hot cathode emits electrons, which are then accelerated toward and through the beam of clusters by an anode. Thermionic ionizers are operable for their purpose, but have significant drawbacks. The most important of the drawbacks is their short lifetimes in some applications. If the beam emitted by the source contains reactive species such as oxygen or chlorine, they may quickly attack the heated cathode and cause it to fail. Also, the positioning of the thermionic ionizer in the most optimum location, close to the cluster source, may result in periodic electrical breakdowns as a result of the interaction of the thermionic electrons and the unclustered gas atoms in the beam.

Accordingly, there is a need for an improved apparatus for producing cluster beams that is less susceptible to degradation by reactive species. The present invention fulfills this need, and further provides related advantages.

SUMMARY OF THE INVENTION

The present invention provides an apparatus for producing a cluster beam that is less susceptible to damage by reactive species in the beam than are prior types of apparatus. The new apparatus is of no greater complexity, and is fully compatible with the use of modifications such as mass separators that are employed in particular applications. The apparatus of the invention operates in a stable fashion.

In accordance with the invention, apparatus for producing an ionized cluster beam comprises means for generating a beam of clustered and unclustered atoms; and means for ionizing the clusters of atoms in the beam, the means for ionizing comprising cathode means for emitting secondary electrons when impacted by ions, and anode means for accelerating the secondary electrons emitted by the cathode means into the beam, the means for ionizing being located sufficiently close to the beam and to the means for generating that a stable plasma may be formed in the beam by the application of a voltage between the anode means and the cathode means, the plasma serving as the source for the ions that impact the cathode means to produce the secondary electrons that ionize the clustered and unclustered atoms.

The means for ionizing is located immediately adjacent the means for generating the beam. It creates a plasma across the width of the beam as the beam emerges from the means for generating. Ionized atoms from the beam are extracted by the anode means to impact the cathode means, and specifically that portion of the cathode means that efficiently emits secondary electrons when impacted by ions. The generated secondary electrons are directed into the plasma to generate further ions, so that the process becomes self sustaining. The secondary electrons also ionize the clusters of atoms within the plasma, which proceed to the target. The plasma creates a sufficiently uniform electrical potential plateau across the width of the beam that the clusters achieve unipotential ionization, a highly desirably state for subsequent acceleration or mass separation.

Stated in terms of the corresponding process, a method of providing a beam of ionized clusters comprises the steps of providing a cluster source that produces a beam containing both clustered atoms the unclustered atoms; providing a cathode that emits secondary electrons when impacted by ions, the cathode being disposed adjacent the beam; and forming a plasma within the beam at a location adjacent the cluster source by injecting energetic secondary electrons produced by the cathode into the beam, and withdrawing ionized but unclustered atoms from the beam to impact the cathode to create additional secondary electrons. The energetic electrons introduced into the beam ionize the clustered and unclustered atoms. The clustered atoms proceed to their target as ionized clusters, and a portion of the unclustered ions are withdrawn from the beam to strike the cathode, forming more secondary electrons to repeat the process.

The cathode is not heated by the passage of a current of electrons flowing therethrough, as in the conventional thermionic ionizer. (The cathode may be heated somewhat by radiation from the plasma and by the impacting of the ions extracted from the plasma, but the cathode can be externally cooled, if necessary, to maintain it at an acceptably low temperature. External cooling has not been necessary in operating embodiments of the invention.) Because the cathode stays cool, it is not degraded by elevated temperature chemical reaction with reactive ions and clusters in the plasma, an important advantage as compared with thermionic ionizers.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
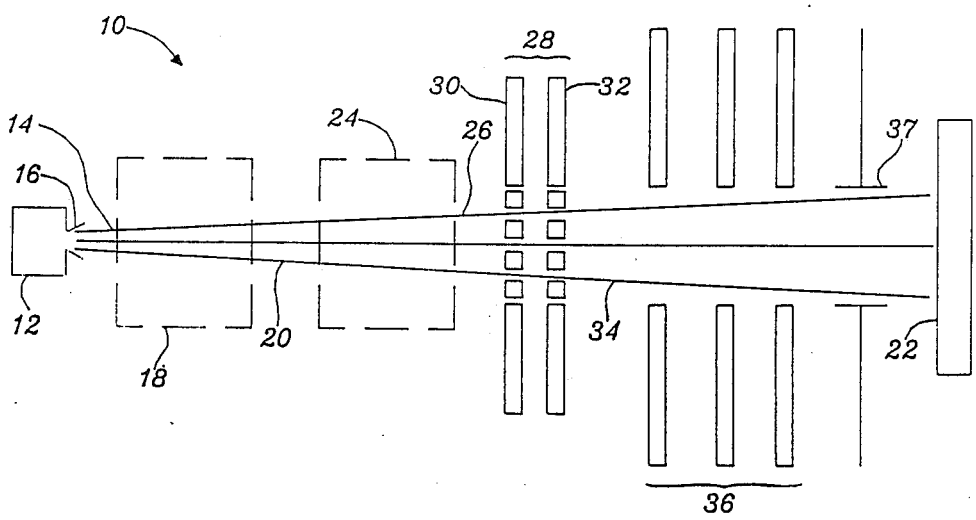
FIG. 1 is a schematic illustration of an apparatus to produce and utilize ionized clusters.

The present invention is embodied in a deposition apparatus 10 illustrated in FIG. 1. Such deposition apparatus 10 is described in greater detail in U.S. Pat. Nos. 4,152,478 and 4,737,637, whose disclosures are incorporated herein by reference. The deposition apparatus 10 includes a cluster source 12 which produces a cluster beam 14. The cluster beam 14 includes clusters of loosely bound atoms and unclustered single atoms, collectively termed particles herein, with the distribution of atoms and clusters determined by the construction of the source, the operating conditions, and the type of atoms being used. The velocities of the clusters and atoms are generally uniform, because of the manner in which the source operates.

In one type of source, atoms are heated in a crucible and emitted from an opening in the top of the crucible. A fraction of the atoms naturally cluster together, but the clustering efficiency of this type of source is low. In another, preferred, type of source 12, illustrated in FIG. 1, clusters are formed by passing a pressurized gas of volatile atoms to be clustered through a sonic or supersonic nozzle 16. Clusters are formed when the gas expands and cools. The velocity of the atoms and clusters is relatively uniform upon ejection from the nozzle 16.

The cluster beam 14, and the atoms and clusters therein, are not ionized when they emerge from the cluster source 12. The beam 14 is passed through an ionizer 18, to be described in greater detail below, wherein the clusters and some atoms are provided with an ionic charge, thereby creating an ionized beam 20. In most instances, it is preferred to ionize the particles positively, and the following description is directed to a system wherein the particles are ionized positively.

The ionized beam 20 contains ionized unclustered atoms, ionized clusters, and unionized atoms and clusters. The presence of the unionized atoms and clusters is of little consequence, since these particles are not electrostatically accelerated and never become energetic. It is, however, often important to separate the unclustered ionized atoms and small ionized clusters from the larger ionized clusters, so that the clusters reaching a target 22 carry about the same energy and charge per atom of the cluster. To separate the larger clusters from the smaller clusters and unclustered ions in the beam 20, the beam 20 is passed through a mass separator 24. An operable mass separator is described in U.S. Pat. No. 4,737,637, whose disclosure is incorporated by reference. A conditioned beam 26 of properly sized, unipotentially ionized clusters is the result.

The conditioned beam 26 of properly sized clusters passes to an accelerator 28. In the accelerator 28, a first apertured electrode 30 is maintained at a potential less negative (for positively ionized clusters) than a second apertured electrode 32. The conditioned cluster beam 26 passes through aligned apertures of the electrodes 30 and 32, respectively, and the particles in the beam 26 are accelerated by the potential difference, producing an accelerated beam 34. The second apertured electrode 32 is typically about 1000 to about 20,000 volts more negative than the first apertured electrode 30, which is permitted to float at the same voltage as the ionizer 18.

When a singly charged cluster of 1000 atoms passes through the electrodes 30 and 32 maintained at a difference of 2000 volts, for example, an energy of 2000 electron volts is imparted to the cluster. The high energy and high mass of the cluster permit the cluster in the accelerated beam 34 to penetrate to the surface of the target 22, even though an undesirable space charge may be present above the surface of the target. Upon impact, the cluster disintegrates, leaving each atom of the disintegrated cluster with the comparatively small energy of about 2 electron volts. The small energy per atom does not permit the atoms to penetrate the surface of the target 22 or otherwise damage the surface and the growing thin film. In fact, energies per atom on the order of about 1–10 electron volts aid in the development of a uniform structure of the film, by giving the atoms sufficient mobility on the surface to move to imperfections and eliminate them.

The accelerated beam 34 is generally well collimated and can pass directly from the accelerator 28 to the target 22. Alternatively, since the clusters of the beam 34 are ionized, they can be focused and deflected by the electrostatic or magnetic techniques used to control the flight of other types of charged particles. An electrostatic lens 36 is used to focus or defocus the accelerated beam 34. Deflection plates 37 deflect the ionized clusters toward particular regions of the target 22. The degree of deflection of the beam 34 is dependent upon the voltage applied to the plates 37, so that the beam may be directed by controlling the voltage to the plates 37. By these techniques, the ionized, properly sized clusters of the accelerated beam 34 may be directed toward a specific area of the target 22, as when the specific area requires a higher density of clusters during the fabrication of a particular electronic device structure.

The apparatus 10 is normally operated within an enclosure that is evacuated by a mechanical pump and a diffusion pump to a vacuum of about $10^{-7}$ torr. The vacuum increases the mean free path of travel of the clusters in the cluster beam, and also reduces the amount of gas in the regions adjacent electrodes, to reduce the possibility of electrical discharges. The ability of the accelerator 28 to achieve high acceleration potential is limited by the pressure, because high pressures permit arcing between the electrodes 30 and 32. A skimmer, to be discussed subsequently, aids in removing gas that could cause arcing. The vacuum also reduces the possibility of undesired chemical reactions on the target 22.

In accordance with the invention, apparatus for producing an ionized cluster beam comprises a source that produces a beam of clustered and unclustered atoms, the source including a nozzle from which the beam is emitted; and an ionizer comprising a frustoconical cathode disposed so that the beam passes along its axis, the cathode being formed at least in part of a material that efficiently emits secondary electrons when impacted by ions, and a frustoconical anode of frustoconical diameter less than that of the cathode and located concentrically within the cathode, the anode being formed of mesh material and disposed so that the beam passes along its axis, the ionizer being located sufficiently close to the beam and to the nozzle that a stable plasma may be formed in the beam by the application of a voltage between the anode and the cathode, the plasma serving as the source for the ions that impact the cathode to produce the secondary electrons that ionize the clustered and unclustered atoms.

Figure 2:
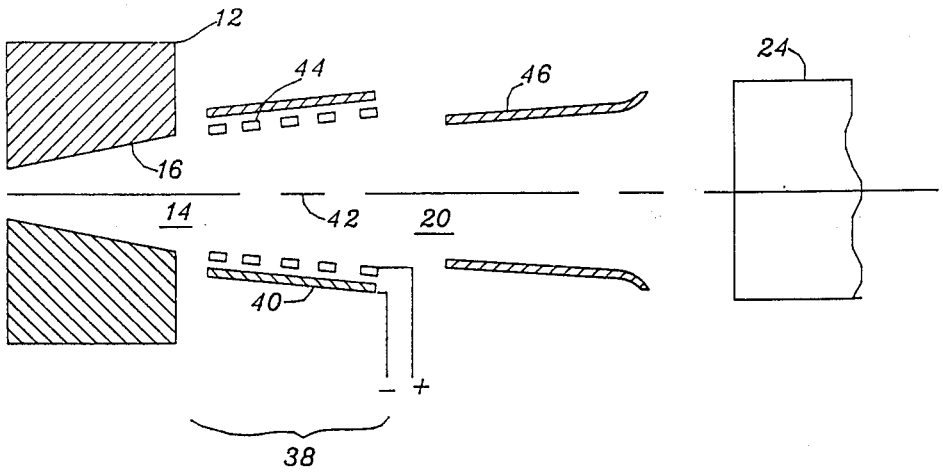
FIG. 2 is a side sectional view of a first embodiment of the ionizer of the invention.

FIG. 2 illustrates one preferred form of the apparatus 10 and in particular an ionizer 38 utilizing a cold cathode design, which may be used as the ionizer 18 of FIG. 1. The ionizer 38 includes a cathode 40 in the shape of a hollow frustoconical section. As used herein, a frustoconical section is a frustum of a hollow conical body that is open on both ends. The frustoconical section normally has sides that diverge slightly (conical apex angle greater than zero), but, as used herein, a frustoconical section may also include a body whose sides are parallel (zero conical apex angle) and thus cylindrical. The frustoconical section is rotationally symmetric about a central axis 42. The present invention may also be applied to sections that are not rotationally symmetric about a central axis, but such irregular geometries introduce nonuniformities into the ionized beam 20. The walls of the cathode 40 are normally a solid material.

At least a portion, and preferably all, of the cathode 40 must be constructed of a material that efficiently emits secondary electrons when ions are impacted thereupon. The most preferred material of construction is stainless steel, which emits secondary electrons and is readily available and fabricated. If a higher efficiency, and correspondingly lower power consumption, are important, materials that have higher yields of secondary electrons per impacted ion may be used. Suitable material choices include copper-beryllium alloys such as the alloy 97.9% Cu, 1.9% Be, 0.2% Ni (or 0.2% Co), all percentages by weight, alloys of magnesium and beryllium, and oxides of some metals, such as aluminum oxide.

The ionizer 38 includes an anode 44, also preferably in the shape of a hollow frustoconical section. The anode 44 has a smaller section diameter than does the cathode 40, and fits within the cathode 40 so that the anode 44 and cathode 40 are concentric with the same central axis 42. The central axis 42 is aligned with the axis of the beam 14, so that the beam 14 passes down the center of the anode 44 and cathode 42. The anode 44 is constructed of a mesh material having wires or other solid pieces separating open areas, in the fashion of window screening. The anode may be constructed of any suitable electrically conducting material, with the preferred material of construction being stainless steel.

The ionizer 38 must be placed near to the nozzle 16 and beam 14. By contrast, conventional thermionic ionizers must be placed a sufficient distance away from the nozzle 16 to avoid producing the combination of thermionic electrons and high gas density that could lead to electrical breakdowns.

The ionizer 38 is placed near to the nozzle 16, because the atomic density in the beam 14 decreases with distance from the nozzle 18, and because a high atomic density is required in order to achieve a stable, self-sustaining plasma in the beam 14. Placing the ionizer 38 close to the nozzle 18 has the advantage that a high efficiency of ion production is attained. The potential drawback of such close placement is disruption of the flow field of the beam 14 by shock waves generated by the presence of the anode 44 and the cathode 40. In the designs illustrated in FIGS. 2 and 3, no portion of the ionizer 38 is in the path of the beam 14, minimizing the possibility of formation of shock waves and extraneous discharges.

The mechanism of formation of a stable plasma is understood from the operation of the ionizer 38. The cathode 40 is maintained at a potential that is negative with respect to the anode 44. The cathode 40 emits secondary electrons when impacted by ions. The secondary electrons are repelled by the cathode 40 and are accelerated to the anode 44, which is maintained several hundred volts positive relative to the cathode 40. A portion of the secondary electrons pass through the mesh openings in the anode 44 and enter the region of the beam 14. These secondary electrons ionize clusters and also ionize unclustered atoms. The ionized clusters pass out of the ionizer 38 as the ionized beam 20. The ionized atoms and free electrons form a plasma within the interior of the ionizer 38. The plasma forms a region of equal potential throughout the cross section of the beam 14, thereby aiding in the formation of a uniform ionized beam 20. A portion of the ionized atoms (ions) pass laterally out of the plasma and through the mesh openings of the anode 40. These extracted ions impact against the cathode 44, generating secondary electrons that perpetuate the process and form a self-sustaining, stable plasma.

The cold cathode ionizer 38 must be sufficiently near to the nozzle 16 so that the atomic density of unclustered atoms in the beam 14 is sufficiently high that enough ions may be formed to sustain the reaction. If the ionizer 38 is placed too far from the nozzle 16 and the beam 14, there will be an insufficient density of unclustered atoms to sustain the plasma. No absolute maximum distance can be stated, because higher applied nozzle pressures permit the distance of separation to be increased. The higher the applied pressure, however, the greater the chances of forming electrical instability in the plasma and the system. Consequently, the ionizer 38 is desirably placed as close as physically possible to the nozzle 16 and the beam 14.

An annular skimmer 46 is positioned around the beam 20, downstream from the ionizer 38, so that the beam 20 passes through the center opening thereof. The skimmer 46 removes diverging particles from the beam, reducing the likelihood of arcing between the electrodes 30 and 32 of the accelerator 28.

In accordance with another embodiment of the invention, apparatus for producing an ionized cluster beam comprises a source that produces a beam of clustered and unclustered atoms, the source including a nozzle from which the beam is emitted; and an ionizer comprising a frustoconical cathode disposed so that the beam passes along its axis, the cathode being formed at least in part of a material that emits secondary electrons when impacted by ions, and an anode physically joined to the source at a location adjacent the nozzle, the ionizer being located sufficiently close to the beam and to the nozzle that a stable plasma may be formed in the beam by the application of a voltage between the anode and the cathode, the plasma serving as the source for the ions that impact the cathode to produce the secondary electrons that ionize the clustered and unclustered atoms.

Figure 3:
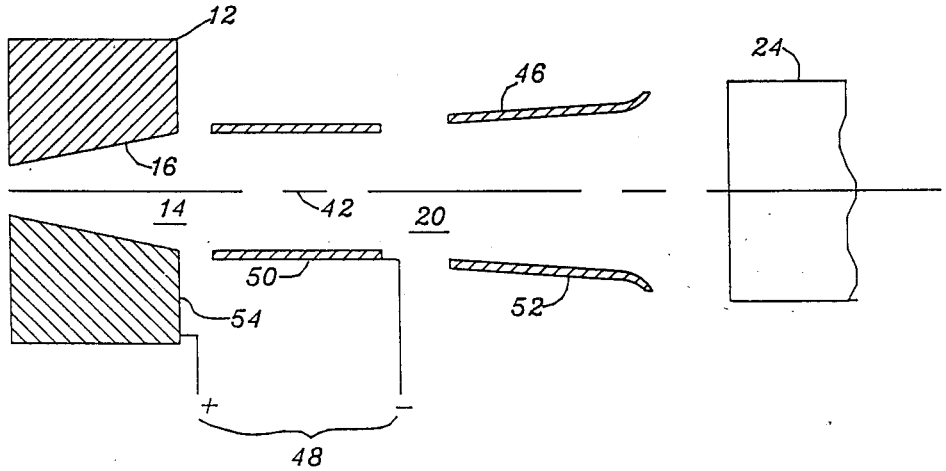
FIG. 3 is a side sectional view of a second embodiment of the ionizer of the invention.

FIG. 3 illustrates another preferred form of the apparatus 10 and in particular an ionizer 48 utilizing a cold cathode design, which may be used as the ionizer 18 of FIG. 1. The ionizer 48 includes a cathode 50 and a skimmer 52 of the same type as the respective cathode 40 and skimmer 46 illustrated in the embodiment of FIG. 2. In this case, the cathode 50 is illustrated as a frustoconical section having a zero apex angle, or alternatively stated, a cylinder. A cylindrical cathode could be used in the apparatus of FIG. 2, and, conversely, a conical cathode could be used in the apparatus of FIG. 3.

An anode 54 is provided as a piece physically connected to the nozzle 16, and the anode 54 may be the nozzle 16. An electrical potential is applied between the cathode 50 and the anode 54 in the same manner as previously described, with the anode 54 several hundred volts positive relative to the cathode 50. Ionization of the clusters and creation of a plasma are accomplished by the same mechanism as for the embodiment of FIG. 2, except that there is no anode through which the secondary electrons must pass to reach the plasma. The geometry of the embodiment of FIG. 3 is less complex, and it has been found that lower voltages are required. At first inspection, it would appear that the voltage plateau in the plasma would be less well defined in the embodiment of FIG. 3 than the embodiment of FIG. 2, but measurements of the resulting beam 20 have shown the results of the two embodiments to be substantially identical, in both cases a level potential distribution.

The ionizer 38 (the FIG. 2 design) and the ionizer 48 (the FIG. 3 design) have been constructed and operated to determine their characteristics, as compared with a conventional thermionic ionizer under comparable operating conditions. The conventional prior thermionic ionizer has an operating voltage of 100 volts, an electron current of $10^{-2}$ amperes, a cluster current of 20 microamperes, and an emitter operating temperature of 2500 K. The ionizer 38 of the invention has an operating voltage of 4000 volts, an electron current of $6\times10^{-4}$ amperes, a cluster current of 10 microamperes, and an operating temperature of ambient. The ionizer 48 of the invention has an operating voltage of 1000 volts, an electron current of $6\times10^{-4}$ amperes, a cluster current of 10 microamperes, and an operating temperature of ambient.

The operating voltages of the cold cathode ionizers are much higher than those of the thermionic ionizer, but the operating temperatures are much lower. With the design configurations indicated, the higher operating voltage are acceptable. The result is that the designs of the invention provide comparable cluster currents without heating the cathode, thereby increasing its lifetime, particularly when reactive materials are used in the apparatus.

Although particular embodiments of the invention have been described in detail for purposes of illustration, various modifications may be made without departing from the spirit and scope of the invention. Accordingly, the invention is not to be limited except as by the appended claims.

What is claimed is:

1. Apparatus for producing an ionized cluster beam, comprising:

means for generating a beam of clustered and unclustered atoms; and means for ionizing the clusters of atoms in the beam, the means for ionizing comprising cathode means for emitting secondary electrons when impacted by ions, anode means for accelerating the secondary electrons emitted by the cathode means into the beam, the means for ionizing being located sufficiently close to the beam and to the means for generating that a stable plasma may be formed in the beam by the application of a voltage between the anode means and the cathode means, the plasma serving as the source for the ions that impact the cathode means to produce the secondary electrons that ionize the clustered and unclustered atoms.

2. The apparatus of claim 1, wherein the means for generating includes a nozzle that emits a beam containing clustered and unclustered atoms.

3. The apparatus of claim 1, wherein the cathode means includes a cathode that is a body of annular cross section disposed so that the beam passes along its axis, and the anode means includes an anode that is a body of annular cross section disposed so that the beam passes along its axis and is formed of a mesh material.

4. The apparatus of claim 3, wherein the cathode and the anode are each frustoconical in shape.

5. The apparatus of claim 4, wherein the cathode and the anode are each cylindrical.

6. The apparatus of claim 1, wherein the anode means is in physical contact with the means for generating.

7. The apparatus of claim 1, wherein the cathode means includes a cathode that is a body of annular cross section disposed so that the beam passes along its axis, and the anode means includes an anode that is in physical contact with the means for generating.

8. The apparatus of claim 1, wherein the cathode is constructed at least in part of a material selected from the group consisting of stainless steel, a copper-beryllium alloy, a magnesium beryllium alloy, and an oxide of a metal.

9. The apparatus of claim 1, further including means for accelerating the ionized clusters.

10. Apparatus for producing an ionized cluster beam, comprising:

a source that produces a beam of clustered and unclustered atoms, the source including a nozzle from which the beam is emitted; and an ionizer comprising a frustoconical cathode disposed so that the beam passes along its axis, the cathode being formed at least in part of a material that emits secondary electrons when impacted by ions, and a frustoconical anode of frustoconical diameter less than that of the cathode and located concentrically within the cathode, the anode being formed of mesh material and disposed so that the beam passes along its axis, the ionizer being located sufficiently close to the beam and to the nozzle that a stable plasma may be formed in the beam by the application of a voltage between the anode and the cathode, the plasma serving as the source for the ions that impact the cathode to produce the secondary electrons that ionize the clustered and unclustered atoms.

11. The apparatus of claim 10, wherein the anode is cylindrical.

12. The apparatus of claim 10, wherein the cathode is cylindrical.

13. The apparatus of claim 10, wherein the cathode is constructed at least in part of a material selected from the group consisting of stainless steel, a copper-beryllium alloy, a magnesium beryllium alloy, and an oxide of a metal.

14. The apparatus of claim 10, further including means for accelerating the ionized clusters.

15. Apparatus for producing an ionized cluster beam, comprising:

a source that produces a beam of clustered and unclustered atoms, the source including a nozzle from which the beam is emitted; and an ionizer comprising a frustoconical cathode disposed so that the beam passes along its axis, the cathode being formed at least in part of a material that emits secondary electrons when impacted by ions, and an anode physically joined to the source at a location adjacent the nozzle, the ionizer being located sufficiently close to the beam and to the nozzle that a stable plasma may be formed in the beam by the application of a voltage between the anode and the cathode, the plasma serving as the source for the ions that impact the cathode to produce the secondary electrons that ionize the clustered and unclustered atoms.

16. The apparatus of claim 15, wherein the cathode is cylindrical.

17. The apparatus of claim 15, wherein the cathode is constructed at least in part of a material selected from the group consisting of stainless steel, a copper-beryllium alloy, a magnesium beryllium alloy, and an oxide of a metal.

18. The apparatus of claim 15, further including means for accelerating the ionized clusters.

19. A method of providing a beam of ionized clusters, comprising the steps of:

providing a cluster source that produces a beam containing both clustered atoms and unclustered atoms;

providing a cathode that emits secondary electrons when impacted by ions, the cathode being disposed adjacent the beam; and forming a plasma within the beam at a location adjacent the cluster source by injecting energetic secondary electrons produced by the cathode into the beam, and withdrawing ionized but unclustered atoms from the beam to impact the cathode to create additional secondary electrons.

20. The method of claim 19, wherein the ionized but unclustered atoms are withdrawn from the beam by an anode.

* * * * *